United States Patent [19]

Ito et al.

[11] Patent Number: 4,691,659

[45] Date of Patent: Sep. 8, 1987

[54] APPARATUS FOR STEERING JOYSTICK OF SHIP

[75] Inventors: Kimiaki Ito; Tetsuo Ueno; Koichi Ueno, all of Yokohama; Susumu Ishii, Tokyo, all of Japan

[73] Assignee: Tokyo Keiki Company, Ltd., Tokyo, Japan

[21] Appl. No.: 879,041

[22] Filed: Jun. 26, 1986

[30] Foreign Application Priority Data

Jul. 6, 1985 [JP] Japan ..... 60-148483

[51] Int. Cl.[4] ..... B63H 25/00

[52] U.S. Cl. ..... 114/144 R; 114/144 RE; 74/480 B; 200/157

[58] Field of Search ..... 114/144 R, 144 E; 74/471 R, 480 B; 200/157

[56] References Cited

U.S. PATENT DOCUMENTS 3,854,380 12/1974 Casey ..... 74/471 XY
4,184,381 1/1980 Comerford et al. ..... 74/471 XY
4,220,111 9/1980 Krautkremer et al. ..... 114/144 R
4,414,438 11/1983 Maier et al. ..... 200/157
4,450,325 5/1984 Luque ..... 200/157
4,501,424 2/1985 Stone et al. ..... 200/157
4,519,335 5/1985 Krautkremer et al. ..... 114/144 RE
4,626,757 12/1986 Granchelli ..... 114/144 RE

*Primary Examiner*—Joseph F. Peters, Jr.
*Assistant Examiner*—Stephen P. Avila
*Attorney, Agent, or Firm*—Wenderoth, Lind & Ponack

[57] ABSTRACT

The rotation angles around the X and Y axes due to the operation of a joystick lever having degrees of freedom of three axes are respectively detected by two rotation angle detectors. A push button switch is provided at the edge of the joystick lever. When the push button switch is not operated, the operating direction and operation amount of the joystick lever are calculated on the basis of the outputs of two rotation angle detectors. When the push button switch was operated, the operating direction and operation amount of the joystick lever are calculated from the output of either one of two rotation angle detectors.

5 Claims, 9 Drawing Figures

APPARATUS FOR STEERING JOYSTICK OF SHIP

BACKGROUND OF THE INVENTION

The present invention relates to an apparatus for steering a joystick of a ship for use in steering of the working ship having a plurality of propelling equipment such as an anchor handling tag supply vessel.

Hitherto, the working ship which is known as an anchor handling tag supply vessel and used in material handling to the oil digging rig is ordinarily equipped with: two rudders and two variable pitch propellers which are provided on the side of the stern; and further a bow thrustor, provided on the side of the bow, for obtaining the thrusts in the lateral direction perpendicular to the progressing direction of ship. These five thrust equipment are respectively controlled by independent levers.

The works which are required for such a working ship include: supply of material to the oil digging rig at a location near the rig; loading and unloading of material by the crane of the rig; anchor handling to move and moor the rig; and the like. For these works, in the disturbance such as wind, tidal current, and the like, it is required to perform the delicate steering operations of the ship at a low speed at the current position such as turn, lateral movement, inclined sailing, holding of the specific point at sea, holding of the bow azimuth, and the like.

To satisfy these requirements, the shipbuilder considers the performances of five thrust equipment provided for the ship and adjusts the respective control levers in accordance with the situation and continues the works for a long period of time. Therefore, such works become fairly large mental and physical burdens to the skilled shipbuilder as well.

The inventors of the present invention has been progressing the development of what is called a joystick control system which can operate five thrust equipment by the operation of a single joystick lever. A conventional joystick apparatus as an input apparatus for use in such a system generally has the structure such that a rotation angle detector is provided for each of X, Y, and Z axes adapted to rotate in association with the operation of the joystick lever. Further, there has been known the apparatus such that the rotation angles around two X and Y axes due to the joystick are detected and another knob separately provided is operated with regard to the Z axis.

However, in such a conventional apparatus in which the rotation angles around three axes due to the operation of the joystick lever are detected, the gimbal structure having three angle detectors is needed, so that there are the following problems. The structure of the apparatus is complicated and the movable portion enlarges, so that it is difficult to realize the small-sized and light-weighted apparatus. On the other hand, with respect to the Z axis, in the case of the apparatus which needs to operate the knob, two operating portions exist, so that it is troublesome to operate them upon steering of the ship while observing the outside condition and the monitor display.

SUMMARY OF THE INVENTION

It is an object of the present invention to provide an apparatus for steering the joystick of a ship which can give the operating inputs around three axes by the operation of a single joystick lever by paying an attention to the point such that in steering of the working ship having five propelling equipment, the ship steering operation is mainly classified to the ship steering operation to move the ship with the bow azimuth kept and the turning operation at the position of the specific point at sea, i.e., to the point such that the operations around the X and Y axes and the operation around the Z axis are not simultaneously executed.

Another object of the invention is to provide a joystick ship steering apparatus having a simple structure and excellent operating performance in which the operating inputs around three axes can be given by the operation of a single joystick lever.

Still another object of the invention is to provide a joystick ship steering apparatus in which: there is provided only a pair of rotation angle detectors for detecting the rotation angles around two X and Y axes from the motion of a joystick lever adapted to be freely operated with respect to three axes; a push button switch is further provided at the edge of the joystick lever; when this push button switch is not operated, a first ship steering command (moving command) is calculated and output on the basis of the operating direction and operation amount of the joystick lever obtained from the rotation angles around the X and Y axes due to the pair of rotation angle detectors; and, on the other hand, when the push button switch was operated, a second ship steering command (turning command) is calculated and output on the basis of the operating direction and operation amount of the joystick lever derived from the rotation angle concerned with one axis by either one of the rotation angle detectors.

Still another object of the invention is to provide a joystick ship steering apparatus in which when a push button switch was depressed, the magnitude of the turning speed is set in accordance with the inclination of a joystick lever operated.

The above and other objects, features, and advantages of the present invention will become more apparent from the following detailed description in conjunction with the accompanying drawings.

DETAILED DESCRIPTION OF THE PREFERRED EMBODIMENT

Figure 1:
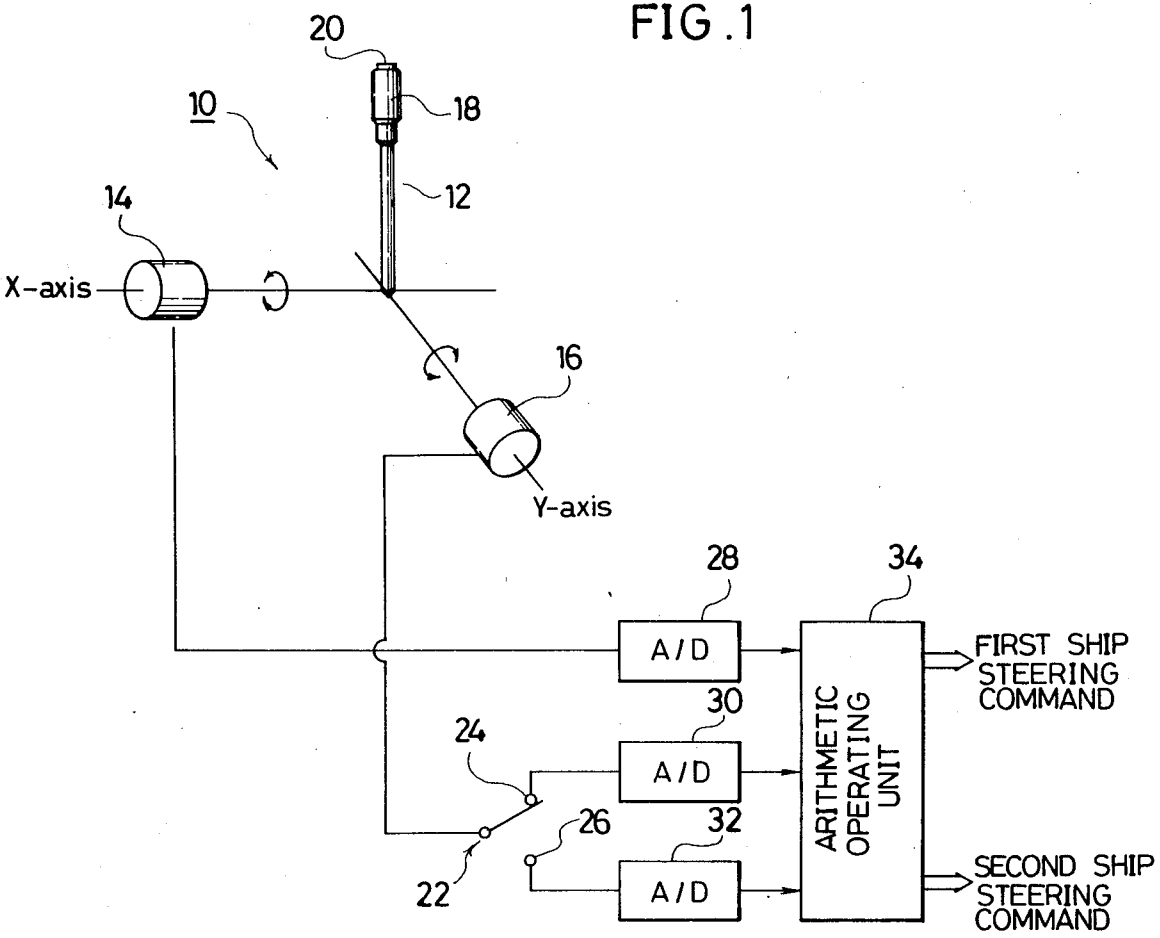
FIG. 1 is an explanatory diagram showing an embodiment according to the present invention.

FIG. 1 is an explanatory diagram showing an embodiment of the present invention.

A constitution will be first described. A joystick unit 10 has a joystick lever 12 which can be freely operated in the directions of three X, Y, and Z axes. The joystick unit 10 is provided with rotation angle detectors 14 and 16 for detecting rotation angles around the X and Y axes due to the joystick lever 12. For example, potentiometers may be used as the detectors 14 and 16. A push button switch 22 is provided in a knob 18 at the edge of the joystick lever 12. The switching operation of the switch 22 can be performed by depressing a switch knob 20 protruded at the edge of the knob 18. The switch 22 is shown as a switch to change over a detection output of the rotation angle detector 16 for the Y axis. The switch 22 is ordinarily switched to the side of a change-over contact 24. Depressing the switch knob 20 once allows the switch 22 to be switched to the side of a change-over contact 26. Further depressing the knob 20 again allows the switch 22 to be returned to the side of the contact 24.

Figure 2:
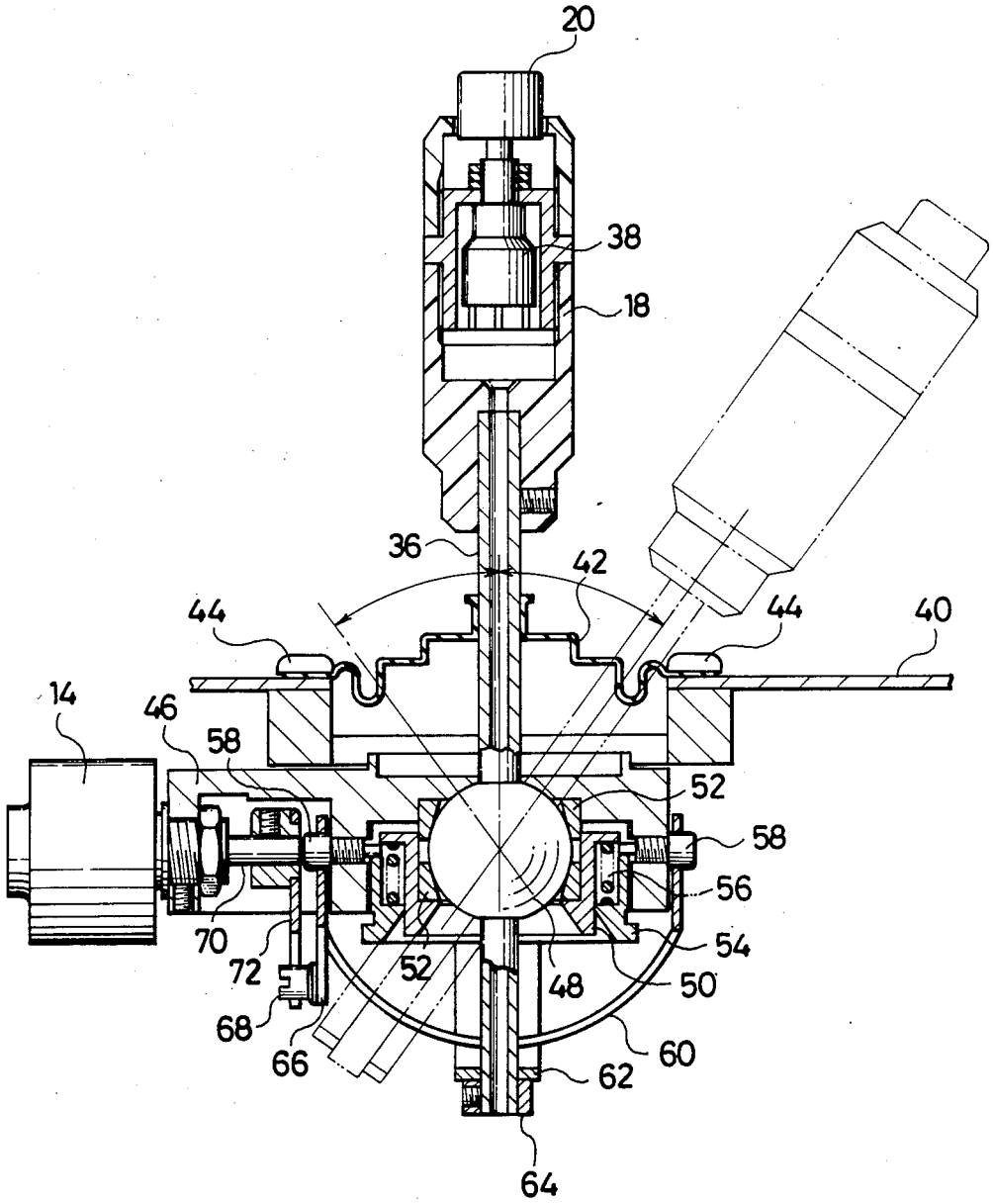
FIG. 2 is a cross sectional view of a joystick unit according to the invention.
Figure 3:
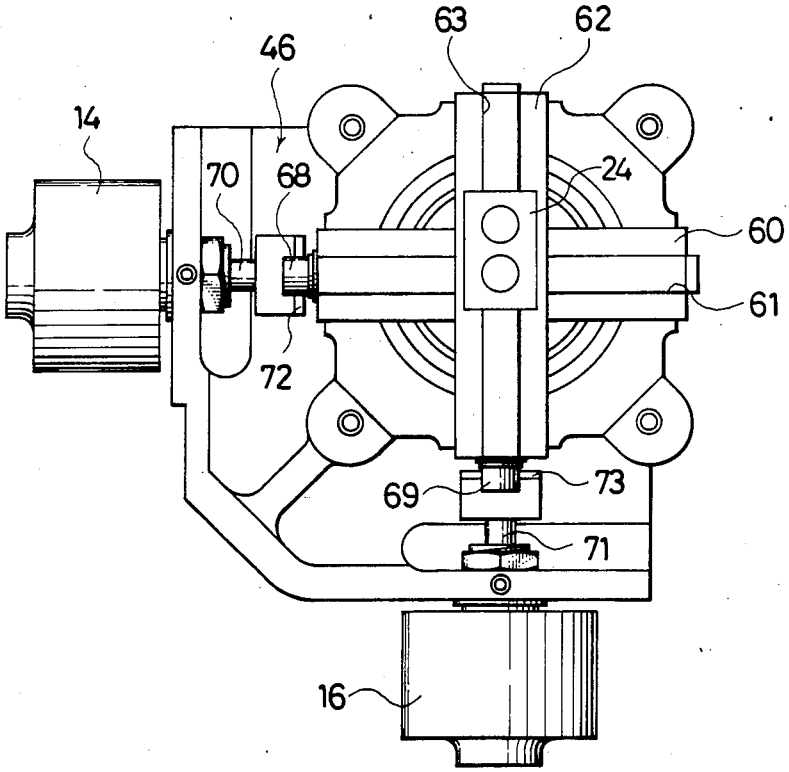
FIG. 3 is a bottom view of the joystick unit of FIG. 2.

FIG. 2 is a cross sectional view showing a practical structure of the joystick unit 10 shown in FIG. 1 and FIG. 3 illustrates a bottom view thereof.

In FIG. 2, a switch unit 38 constituting the push button switch 22 is provided in the knob 18 attached to the edge of a lever rod 36. The switching operation can be performed by depressing the knob 20 projected from the edge of the knob 18. The lever rod 36 is protruded through a dust cover 42 to a location above a casing 40 in the ship steering unit. A housing 46 of the unit is fixed to the inside of the casing 40 by screws 44. The housing 46 has a downward opening at the position where the lever rod 36 pierces. A ball shaft portion 48 is fixed to the lever rod 36 in the housing 46. The ball shaft portion 48 is slidably supported by a bearing 52 having the structure vertically divided into two parts and arranged in a bearing casing 50. The lever rod 36 can be operated around three axes due to such a bearing structure. A pressing cover 54 is screwed and attached to the lower portion of the bearing casing 50 in which the ball shaft portion 48 is slidably mounted. A spring 56 is inserted between the pressing cover 54 and the bearing casing 50.

A Y-axis guide rail 60 is rotatably attached by screw shafts 58 below the housing 46 from which the lever rod 36 protrudes. An X-axis guide rail 62 is also similarly attached below the Y-axis guide rail 60 in the direction perpendicular thereto so as to be rotatable for the housing 46. A slip-out preventing member 64 is attached to the lower end of the lever rod 36 projected from the X-axis guide rail 62. A rotary lever 66 is attached to the left side of the Y-axis guide rail 60. An engagement pin 68 attached to the lower end of the rotary lever 66 is fitted into the groove at the edge of a lever 72 fixed to an input shaft 70 of the detector 14 fixed to the left side of the housing 46. Due to this, the motion around the X axis due to the operation of the lever rod 36 is transmitted to the input shaft 70.

FIG. 3 shows a bottom view of FIG. 2. The rotation angle detector 16 for the Y axis is provided at the position of the housing 46 which crosses perpendicularly to the rotation angle detector 14 for the X axis. An engagement pin 63 provided for the rotary lever at one end of the guide rail 62 is fitted into a lever 73 fixed to an input shaft 71. Due to this, the motion around the Y axis by the operation of the lever rod 36 is transmitted to the rotation angle detector 16 for the Y axis.

Referring again to FIG. 1, an output of the detector 14 for the X axis is input to an A/D converter 28. An analog detection signal indicative of the angle of rotation is converted to a digital signal by the A/D converter 28 and this digital signal is input to an arithmetic operating unit 34. On the other hand, an output of the detector 16 for the Y axis is input to an A/D converter 30 or 32 through the push button switch 22. An analog detection signal indicative of the angle of rotation is converted to a digital signal by the A/D converter 30 or 32 and this digital signal is input to the operating unit 34.

When the converted outputs of the A/D converters 28 and 30 are obtained, namely, when the switch 22 is switched to the side of the contact 24, the operating unit 34 obtains the operating direction and operation amount of the joystick lever 12 in the two-dimensional X-Y coordinates thereof from the rotation angles around the X and Y axes by first operation amount detecting means. Then, the operating unit 34 outputs a ship steering command (first ship steering command) to move the ship in parallel with the position held on the basis of the operating direction and operation amount obtained. On the other hand, by depressing the switch knob 18 provided for the joystick lever 12 and switching the push button switch 22 to the side of the contact 26, when the converted output is obtained from the A/D converter 32 provided for the Z axis, the detected rotation angle around the X axis derived from the A/D converter 28 is ignored. The operating unit 34 detects the operating direction and operation amount by second operation amount detecting means on the basis of the detection data from the A/D converter 32, i.e., the rotation angle around the Y axis due to the joystick lever 12. Then, the operating unit 34 outputs a ship steering command (second ship steering command) to turn the ship with the position of the specific point at sea held.

Figure 4A:
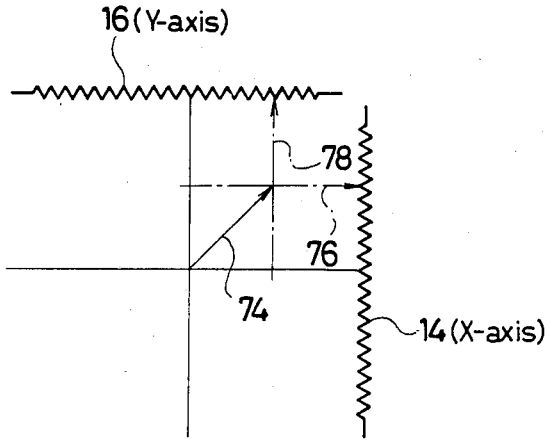
FIG. 4A is an explanatory diagram showing the state of a rotation angle detector when a push button switch is not depressed.

Namely, for the switching function by the push button switch 22, when the switch 22 is switched to the side of the contact 24 as shown in the diagram, the operating inputs of the operating direction and amount of movement of the joystick lever 12 indicated by a vector 74 are obtained as shown in FIG. 4A by the first operation amount detecting means from the detection output to be determined on the basis of the positions of slide members 76 and 78 of the detector 14 for the X axis and the detector 16 for the Y axis which are constituted by the potentiometers.

Figure 4B:
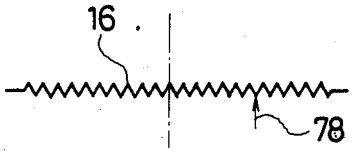
FIG. 4B is an explanatory diagram showing the state of the rotation angle detector when the push button switch is depressed.

On the other hand, when the switch 22 is switched to the side of the contact 26, the detection input is switched to the input by only the Y-axis detector 16 shown in FIG. 4B. The operation amount of the joystick lever 12 is detected by the second operation amount detecting means from the position of the slide member 78 shown by an arrow. The operating direction is decided from the lateral moving direction for the neutral position. For example, in this state, the ship enters the turning mode. Therefore, if the slide member 78 is located on the right side as shown in the diagram, a command to turn the ship to the right will be generated. If the slide member 78 is located on the left side, on the contrary, a command to turn the ship to the left will be generated. The turning speed is determined in dependence on the amount of movement. The ship steering operation according to the embodiment of FIG. 1 will now be described. First, as diagrammatically shown together with the joystick lever in FIG. 5, it is assumed that a ship 100 to be steered according to the invention is equipped with five propelling equipment consisting of two variable pitch propellers 102L and 102R and two rudders 104L and 104R on the side of the stern and further a bow thrustor 106 for generating the thrust in the lateral direction on the side of the bow. First, as shown in FIG. 5, in the case where the ship 100 locating at the specific point at sea is moved in parallel with the position held, the switch knob 20 is operated so as to change over the switch 22 to the side of the contact 24 as shown in FIG. 1 and in this state, the joystick lever 12 is inclined in the direction where the ship is to moved.

The motion of the joystick lever 12 at this time is detected by the rotation angle detectors 14 and 16 for the X and Y axes. The analog detection signals indicative of the rotation angles around the X and Y axes from the detectors 14 and 16 are converted into the digital signals by the A/D converters 28 and 30 and thereafter the digital signals are input to the arithmetic operating unit 34. The operating unit 34 calculates the operating direction and operation amount of the joystick lever 12 from the detected rotation angles of the X and Y axes as shown in FIG. 4A and controls five thrust equipment shown in FIG. 5, thereby allowing the ship 100 to be moved in parallel at the speed corresponding to the amount of movement of the joystick.

Figure 5:
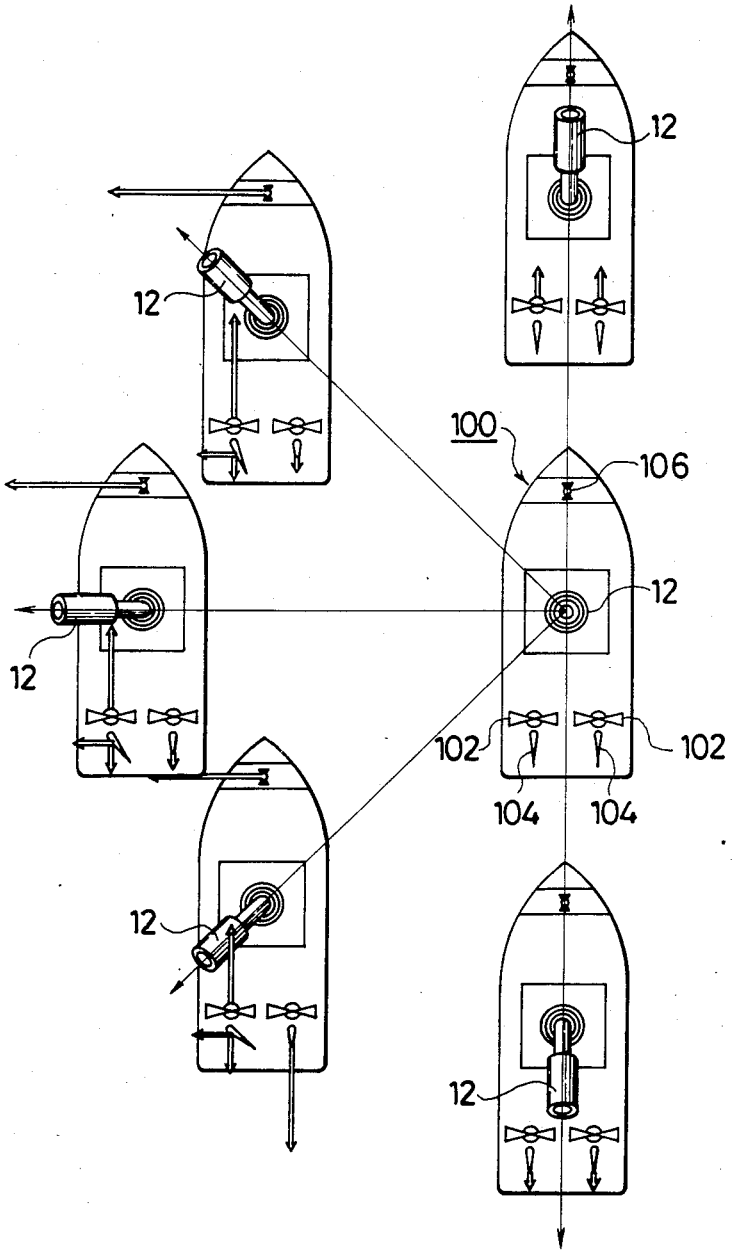
FIG. 5 is an explanatory diagram showing the parallel movement of a ship due to the ship steering input according to the invention.

An arrow shown in each thrust equipment in FIG. 5 represents the thrust to be generated due to the parallel movement in each direction.

Figure 6A:
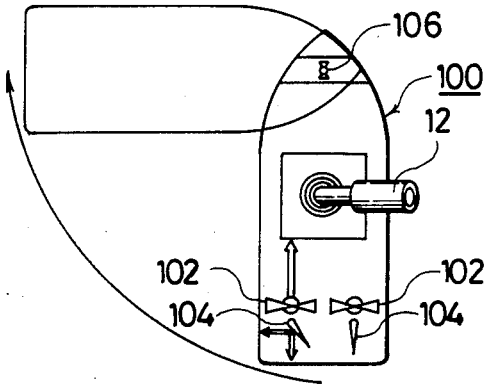
FIG. 6A is an explanatory diagram showing the right turn of a ship around the bow as a rotational center due to the ship steering input according to the invention.
Figure 6B:
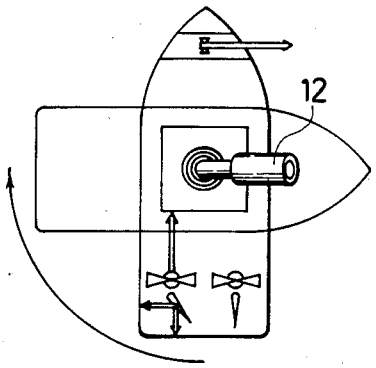
FIG. 6B is an explanatory diagram showing the right turn of a ship around the center of hull as a rotational center due to the ship steering input according to the invention.
Figure 6C:
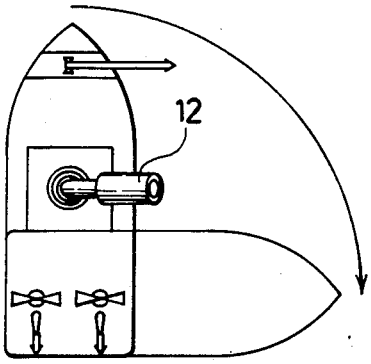
FIG. 6C is an explanatory diagram showing the right turn of a ship around the stern as a rotational center due to the ship steering input according to the invention.

Next, in the case where the ship is turned with the position held, the switch 22 is switched to the side of the contact 26 by the operation of the switch knob 20 and as diagrammatically shown in explanatory diagrams together with the joystick lever 12 in FIGS. 6A, 6B, and 6C, the joystick lever 12 is inclined to the right, so that the ship will be turned to the right under control of five thrust equipment. On the contrary, if the joystick lever 12 is inclined to the left, the ship will be turned to the left.

On the other hand, the turning mode is classified into three modes: the turning mode in which the ship is turned around the bow as a rotational center as shown in FIG. 6A; the turning mode in which the ship is turned around the center of the hull as a rotational center as shown in FIG. 6B; and the turning mode in which the ship is turned around the stern as a rotational center as shown in FIG. 6C. Either one of these three turning modes is selected by another switch (not shown).

The above embodiment has been described with respect to the example of the control of the working ship having five thrust equipment consisting of two variable pitch propellers, two rudders, and one bow thrustor. However, the invention is not limited to this example but can be applied as it is to the proper ship steering operation such that the operating inputs of either two axes among the operating inputs of the X, Y, and Z axes and the operating input of the other one axis are not simultaneously performed.

In the embodiment of FIG. 1, the detection output of the rotation angle detector 16 for the Y axis has been switched by the push button switch 22. However, the output of the rotation angle detector 14 for the X axis may be also switched by the switch 22.

According to the present invention as described above, in the case where the operating inputs around three X, Y, and Z axes are needed as well, it is sufficient to merely provide two rotation angle detectors. Therefore, the structure is simplified and the small-sized and light-weighted apparatus can be realized as compared with the conventional apparatus for detecting the rotation angles around three axes. Further, with respect to the detection of the operating input around the Z axis, the input mode is changed over by merely operating the push button switch provided at the edge of the joystick lever. Therefore, as compared with the case where the operating input of the Z axis is executed by the knob separately provided, the operating performance is fairly excellent and the parallel movement and the turning operation of the working ship can be easily performed due to the operation of the single joystick lever.

What is claimed is:

1. A joystick ship steering apparatus for use in steering of a ship equipped with a propelling equipment for generating a thrust in the back and forth directions, a rudder for changing the direction of the thrust of said propelling equipment, and a propelling equipment for generating a thrust in the lateral direction, said apparatus comprising:

a joystick unit having a joystick lever which can be freely operated around three X, Y, and Z axes;

first rotation angle detecting means for detecting an angle of rotation around the X axis by said joystick lever;

second rotation angle detecting means for detecting an angle of rotation around the Y axis by the joystick lever;

a push button switch provided at the edge of the joystick lever; and arithmetic operating means for calculating the operating direction and an amount of operation of the joystick lever from detection outputs of said first and second rotation angle detecting means when said push button switch is not operated, and for calculating the operating direction and the amount of operation of the joystick lever from the detection output of either one of said first and second rotation angle detecting means when said push button switch was operated.

2. A joystick ship steering apparatus according to claim 1, wherein said joystick unit comprises:

sphere bearing means for supporting the lower end side of said joystick lever to a housing such that said joystick lever can freely swing with degrees of freedom of three axes;

a first rail member which is rotatably attached to said housing below said sphere bearing means and into which the lower end of the joystick lever is fitted and which can rotate around the X axis;

a second rail member which is rotatably attached for said housing in the direction perpendicular to said first rail member below said sphere bearing means and into which the lower end of the joystick lever is fitted and which can rotate only around the Y axis;

a first transmitting mechanism for transmitting the rotation of said first rail member to said first rotation angle detecting means; and a second transmitting mechanism for transmitting the rotation of said second rail member to said second rotation angle detecting means.

3. A joystick ship steering apparatus according to claim 1, wherein first and second potentiometers are provided as said first and second rotation angle detecting means, and said arithmetic operating means is provided with:

first operation detecting means for detecting the operating direction of said joystick lever from the synthesized vector direction of output voltages of said first and second potentiometers and also detecting an amount of operation of the joystick lever from a magnitude of a synthesized vector voltage of said output voltages when said push button switch is not operated; and second operation detecting means for detecting the operating direction of the joystick lever from the moving direction of said first or second potentiometer and also detecting the amount of operation of the joystick lever from the magnitude of said output voltage when said push button switch was operated.

4. A joystick ship steering apparatus according to claim 1, wherein said arithmetic operating means has means for outputting a ship steering command to move the ship in parallel in the operating direction of said joystick lever and at the speed to be determined by the operation amount of the joystick lever, said operating direction and operation amount of the joystick lever being derived by calculating the detection outputs of said first and second rotation angle detecting means when said push button switch is not operated.

5. A joystick ship steering apparatus according to claim 1, wherein said arithmetic operating means has means for outputting a ship steering command to turn the ship in the turning direction to be determined by the operating direction of said joystick lever and at the turning angular velocity corresponding to the operation amount of the joystick lever with the current position of the hull of said ship held, said operating direction and operation amount of the joystick lever being derived by calculating the detection output of either one of said first and second rotation angle detecting means when said push button switch was operated.

* * * * *